US007182032B1

(12) United States Patent
Lindemann

(10) Patent No.: US 7,182,032 B1
(45) Date of Patent: Feb. 27, 2007

(54) CLAMP TOOL DEVICE AND METHOD OF USING

(76) Inventor: David C. Lindemann, 8359 Lent Trail, Stacy, MN (US) 55079

( * ) Notice: Subject to any disclaimer, the term of this patent is extended or adjusted under 35 U.S.C. 154(b) by 870 days.

(21) Appl. No.: 10/255,808

(22) Filed: Sep. 25, 2002

(51) Int. Cl.
*B63B 21/00* (2006.01)

(52) U.S. Cl. ..... 114/230.1; 114/364

(58) Field of Classification Search ..... 114/230.1, 114/294, 126, 364; 248/229.25, 540, 539, 248/229.15
See application file for complete search history.

(56) References Cited

U.S. PATENT DOCUMENTS 2,526,871 A * 10/1950 Johnson ..... 114/230.1
2,945,713 A * 7/1960 Sears ..... 403/73
3,108,565 A * 10/1963 Cain ..... 416/74
3,238,912 A * 3/1966 Perlick ..... 114/230.1
4,595,373 A * 6/1986 Giroux ..... 440/104
4,862,818 A * 9/1989 Sullivan ..... 114/126
5,529,272 A * 6/1996 Baublitz, Sr. ..... 248/231.71
6,439,522 B1 * 8/2002 Yeh ..... 248/231.71
6,688,569 B1 * 2/2004 Weiss ..... 248/229.15

* cited by examiner

*Primary Examiner*—Stephen Avila

(57) ABSTRACT

A new and improved clamp tool device and method of using the device is disclosed for use in holding a boat in a relatively stationary position while the boat is floating in shallow water. The clamp tool device comprises: a first C-clamp having a top edge; and a second C-clamp orthogonally attached to the first C-clamp, wherein the back edge of the second C-clamp is attached to the top edge of the first C-clamp. The method of using the clamp tool device comprises the steps of getting, obtaining, positioning, ramming, securing, and tightening.

15 Claims, 2 Drawing Sheets

CLAMP TOOL DEVICE AND METHOD OF USING

FIELD OF THE INVENTION

The present invention relates to tool devices, more particularly, to a clamp tool device for coupling together the edge of a boat and an oar in order to stabilize the boat floating in relatively shallow water.

DESCRIPTION OF THE PRIOR ART

Recreational activities associated with boating range from water skiing, fishing, and even hunting. A number of these boating activities require that the boat be brought to a relatively stable position so that the person using the boat can use the boat as a relatively safe and stable platform. In particular, duck hunting often requires a boat to be hidden in shallow water surrounded by weeds, so that the duck hunter can effectively kill foal. Therefore, it would be very desirable to have a relatively stable boat to enhance safety as well as improve hunting efficiency. Unfortunately, an anchor and an associated chair impose little stability and are also bulky and difficult to manipulate.

A wide variety of clamp tool device is currently available on the commercial market and an even larger number of these types of devices are known in the art of clamp tool device, for example, the oar lock disclosed by Gunderson in U.S. Pat. No. 1,263,884; the paddle or oar suspension device disclosed by Spiehler in U.S. Pat. No. 2,504,461; the oarlock disclosed by White and Iglowski in U.S. Pat. No. 2,673,992; the sculling apparatus disclosed by Cain in U.S. Pat. No. 3,108,565; the sculling support disclosed by McClay, Jr. in U.S. Pat. No. 3,335,439; and the clamp disclosed by Knudsen in U.S. Pat. No. D178,249.

While all of the above-described devices fulfill their respective, particular objectives and requirements, the aforementioned patents do not describe a clamp tool device having a first and second C-clamp orthogonally to each other. This combination of elements would specifically match the user's particular individual needs of making it possible to mount one end of the device onto the gunnel edge of a boat and secure the other end of the device to an oar stuck in a muddy bottom layer of a lake, thereby stabilizing the boat. The above-described patents make no provision for a clamp tool device having a first and second C-clamp orthogonally to each other.

Therefore, a need exists for a new and improved clamp tool device having a first and second C-clamp orthogonally to each other. In this respect, the clamp tool device according to the present invention substantially departs from the conventional concepts and designs of the prior art, and in doing so provides an apparatus primarily developed for the purpose of providing a device which can mount one end of the device onto the gunnel edge of a boat and secure the other end of the device to an oar stuck in a muddy bottom layer of a lake, thereby stabilizing the boat.

SUMMARY OF THE INVENTION

The present device and method of using the device, according to the principles of the present invention, overcomes the shortcomings of the prior art by providing new and improved clamp tool device and method of using the device for use in holding a boat in a relatively stationary position while the boat is floating in shallow water. The clamp tool device comprises: a first C-clamp having a top edge; and a second C-clamp orthogonally attached to the first C-clamp, wherein the back edge of the second C-clamp is attached to the top edge of the first C-clamp. The method of using the clamp tool device comprises the steps of getting, obtaining, positioning, ramming, securing, and tightening.

In view of the foregoing disadvantages inherent in the known type clamp tool devices now present in the prior art, the present invention provides an improved clamp tool device, which will be described subsequently in great detail, is to provide a new and improved clamp tool device which is not anticipated, rendered obvious, suggested, or even implied by the prior art, either alone or in any combination thereof.

To attain this, the present invention essentially comprises: a first C-clamp having a top edge; and a second C-clamp orthogonally attached to the first C-clamp, wherein the back edge of the second C-clamp is attached to the top edge of the first C-clamp.

There has thus been outlined, rather broadly, the more important features of the invention in order that the detailed description thereof that follows may be better understood, and in order that the present contribution of the art may be better appreciated.

The invention may also include any number of differently designed shapes of the upper and lower lips of each C-clamp to accommodate study fitment about either the gunnel or the oar. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clamp tool device that has all the advantages of the prior art clamp tool device and none of the disadvantages.

It is another object of the present invention to provide a new and improved clamp tool device that may be easily and efficiently manufactured and marketed.

An even further object of the present invention is to provide a new and improved clamp tool device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new clamp tool device that provides in the apparatuses and methods of the prior art some of the advantages thererof, while simultaneously overcoming some of the disadvantages normally associated therewith.

Even still another object of the present invention is to provide a clamp tool device having a first and second C-clamp orthogonally to each other. This combination of elements makes it possible to mount one end of the device onto the gunnel edge of a boat and secure the other end of the device to an oar stuck in a muddy bottom layer of a lake, thereby stabilizing the boat.

Lastly, it is an object of the present invention to provide a new and improved method of using the clamp tool device comprises the steps of getting, obtaining, positioning, ramming, securing, and tightening.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
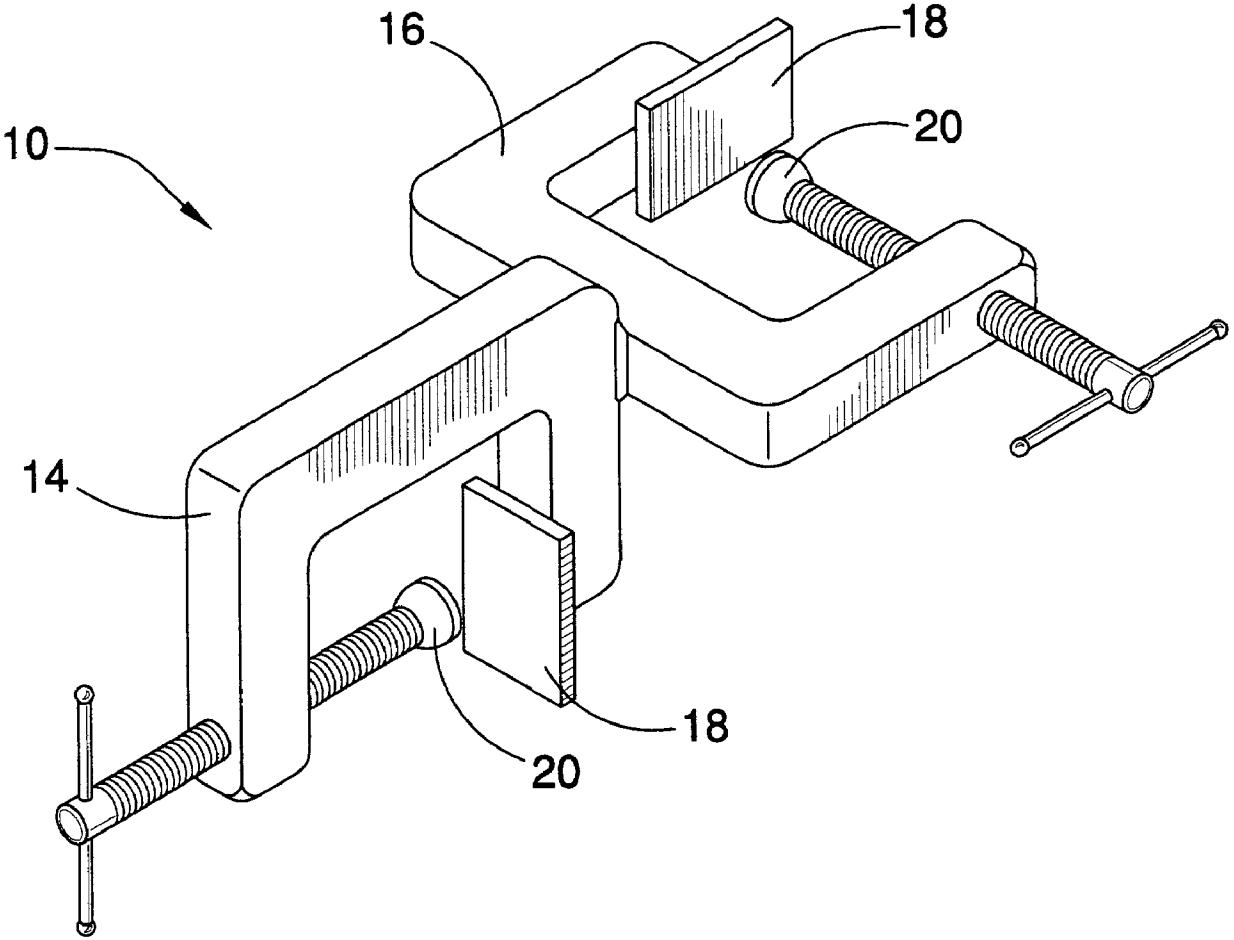
FIG. 1 is a perspective view of a preferred embodiment of the clamp tool device constructed in accordance with the principles of the present invention.
Figure 2:
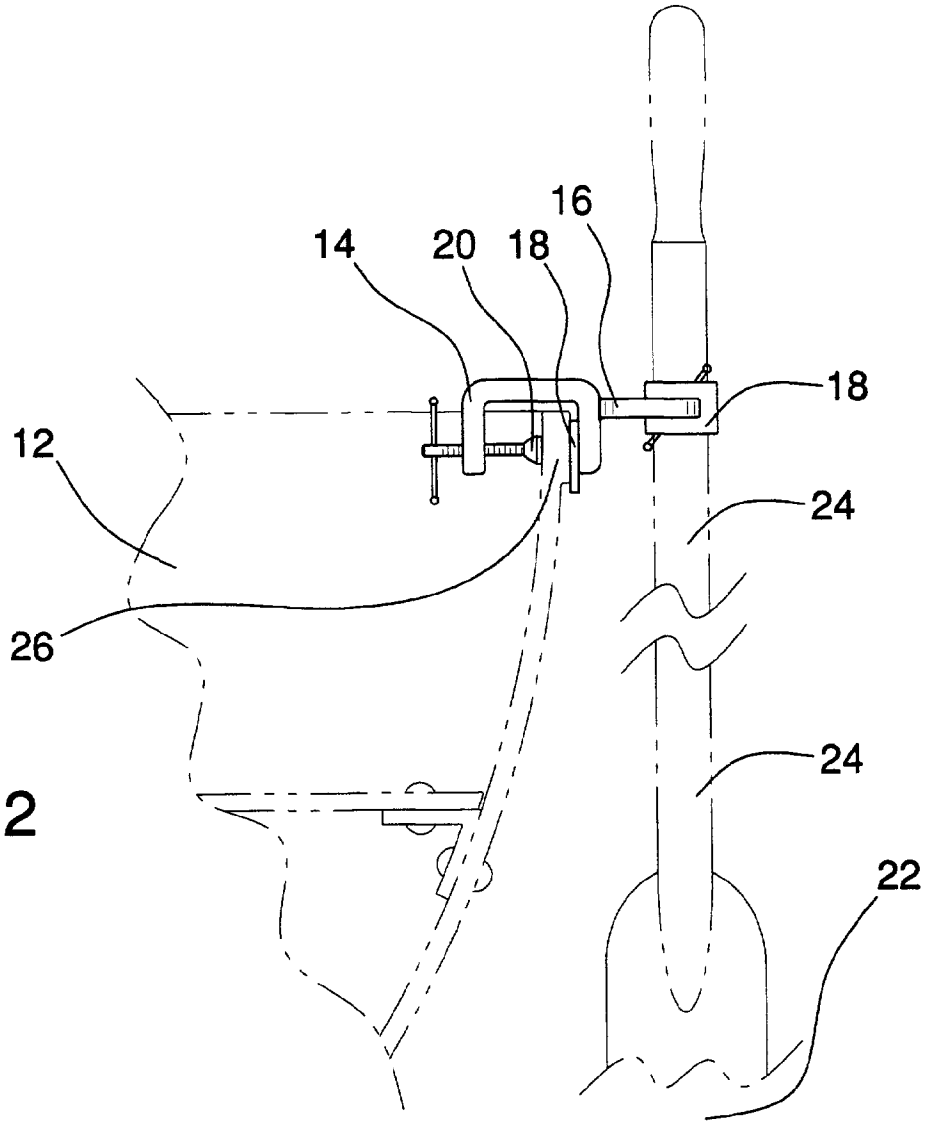
FIG. 2 is a side view of a preferred embodiment of the clamp tool device of the present invention.

Referring now to the drawings, and in particular FIGS. 1 to 2 thereof, one preferred embodiment of the present invention is shown and generally designated by the reference numeral 10. One preferred embodiment of the clamp tool device 10 for use in holding a boat 12 in a relatively stationary position while the boat 12 is floating in shallow water, the device 10 comprises: a first C-clamp 14 having a top edge; and a second C-clamp 16 orthogonally attached to the first C-clamp 14, wherein the back edge of the second C-clamp 16 is attached to the top edge of the first C-clamp 14.

Another preferred embodiment of the clamp tool device 10 consists essentially of: a first C-clamp 14 having a top edge, a generally rectangular shaped flat upper lip 18, and a generally circular flat lower lip 20; and a second C-clamp 16 having a back edge, a generally rectangular shaped flat upper lid, and a generally circular flat lower lip 20, the second C-clamp 16 is orthogonally attached to the first C-clamp 14, wherein the back edge of the second C-clamp 16 is attached to the top edge of the first C-clamp 14.

The device 10 is may be made of any commercially available material. One preferred configuration is the device 10 is made of metal wherein the metal is selected form the group consisting of chrome, aluminum, tin, copper, iron, nickel, manganese, titanium, carbon steel, galvanized steel, brass, bronze and admixtures thereof.

The first C-clamp 14 of the device 10 may have any commercially available shape as long as the first C-clamp 14 has ajaw with upper and lower lips that are able to reach around a gunnel 26 of a boat 12. One preferred configuration of the first C-clamp is that it has a generally rectangular shaped flat upper lip 18. Another preferred configuration of the first C-clamp 14 is that it has a generally circular shaped flat lower lip 20. Yet another preferred configuration of the first C-clamp 14 is that it has a generally rectangular shaped flat lower lip 20.

The second C-clamp 16 of the device 10 may have any commercially available shape as long as the second C-clamp 16 has a jaw with upper and lower lips that are able to reach around a given oar 24 or a similar device such as a pole or a paddle. One preferred configuration of the second C-clamp 16 is that it has a generally rectangular shaped flat upper lip 18. Another preferred configuration of the second C-clamp 16 is that it has a generally rectangular shaped flat upper lip 18. Yet another preferred configuration of the second C-clamp 16 is that it has a generally rectangular shaped concave upper lip 18. Still yet another preferred configuration of the second C-clamp 16 is that it has a generally rectangular shaped concave upper lip 18. Even another preferred configuration of the second C-clamp 16 is that it has a generally circular shaped flat lower lip 20. Yet another preferred configuration of the second C-clamp 16 is that it has a generally rectangular shaped flat lower lip 20. Still another preferred configuration of the second C-clamp 16 is that it has a generally rectangular shaped concave lower lip 20.

A preferred embodiment of the method of using a clamp tool device 10 for use in holding a boat 12 in a relatively stationary position while the boat 12 is floating in shallow water, the method comprising the steps of getting, obtaining, positioning, ramming, securing, and tightening. The obtaining step comprises obtaining the device 10 consisting essentially of: a first C-clamp 14 having a top edge, a generally rectangular shaped flat upper lip 18, and a generally circular flat lower lip 20; and a second C-clamp 16 having a back edge, a generally rectangular shaped flat upper lid, and a generally circular flat lower lip 20, the second C-clamp 16 is orthogonally attached to the first C-clamp 14, wherein the back edge of the second C-clamp 16 is attached to the top edge of the first C-clamp 14. The getting step comprises getting into the boat 12 floating in a lake having a muddy bottom 22, wherein the boat 12 has a gunnel 26 edge and an oar 24. The positioning step comprises positioning the boat 12 in the lake at a depth less than the length of the oar 24. The tightening step comprises tightening the lower and upper lips (20 and 18) of the first C-clamp 14 of the device 10 onto the gunnel 26 of the boat 12. The ramming step comprises ramming the distal end of the oar 24 into the bottom muddy bottom 22 of the lake. The securing step comprises securing the lower and upper lips (20 and 18) of the second C-clamp 16 of the device 10 onto the proximate end of the oar 24.

Referring now to FIG. 1 which depicts a perspective view of a preferred embodiment of the clamp tool device 10 showing a first C-clamp 14 having a top edge, a generally rectangular shaped flat upper lip 18, and a generally circular flat lower lip 20; and a second C-clamp 16 having a back edge, a generally rectangular shaped flat upper lid, and a generally circular flat lower lip 20, the second C-clamp 16 is orthogonally attached to the first C-clamp 14, wherein the back edge of the second C-clamp 16 is attached to the top edge of the first C-clamp 14.

Referring now to FIG. 2 which depicts a side view of a preferred embodiment of the clamp tool device 10 showing the lower and upper lip (20 and 18) of the first C-clamp 14 tightened onto the gunnel 26 of the boat 12; the distal end of the oar rammed into the muddy bottom 22 of the lake; and the lower and upper lip (20 and 18) of the second C-clamp 16 secured onto the proximate end of the oar 24, thereby stabilizing the boat 12 floating in the lake.

As to the manner of usage and operation of the present invention, the same should be apparent from the above description. Accordingly, no further discussion relating to the manner of usage and operation will be provided.

While a preferred embodiment of the clamp tool device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or comprising" or the term "includes or variations, thereof, or the them "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combination any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clamp tool device for use in holding a boat in a relatively stationary position while the boat is floating in shallow water, said device comprising:

a first C-clamp having a top edge, an upper lip, and a lower lip; and a second C-clamp having a back edge, an upper lip, and a lower lip, wherein said second C-clamp is orthogonally attached to said first C-clamp, wherein the back edge of said second C-clamp is in direct contact with the top edge of said first C-clamp such that said upper lip and said lower lip of said first C-clamp are orthogonal to said upper lip and said lower lip of said second C-clamp.

2. The device described in claim 1 wherein said device is made of metal.

3. The device described in claim 2 wherein said metal is selected form the group consisting of chrome, aluminum, tin, copper, iron, nickel, manganese, titanium, carbon steel, galvanized steel, brass, bronze and admixtures thereof.

4. The device described in claim 1 wherein said device is made of cast iron.

5. The device described in claim 1 wherein said device is made of aluminum.

6. The device described in claim 1 wherein said device is made of stainless steel.

7. The device described in claim 1 wherein said device is made of brass.

8. The device described in claim 1 wherein said device is made of bronze.

9. The device described in claim 1 wherein said upper lip of said first C-clamp is generally rectangular shaped and flat.

10. The device described in claim 1 wherein said upper lip of said second C-clamp is generally rectangular shaped and flat.

11. The device described in claim 9 wherein said upper lip of said second C-clamp is generally rectangular shaped and flat.

12. The device described in claim 1 wherein said lower lip of said first C-clamp is generally circular shaped and flat.

13. The device described in claim 1 wherein said lower lip of said second C-clamp is generally circular shaped and flat.

14. A clamp tool device for use in holding a boat in a relatively stationary position while the boat is floating in shallow water, said device consisting essentially of:

a first C-clamp having a top edge, a generally rectangular shaped flat upper lip, and a generally circular flat lower lip; and a second C-clamp having a back edge, a generally rectangular shaped flat upper lid, and a generally circular flat lower lip, said second C-clamp is orthogonally attached to said first C-clamp, wherein the back edge of said second C-clamp is in direct contact with the top edge of said first C-clamp such that said upper lip and said lower lip of said first C-clamp are orthogonal to said upper lip and said lower lip of said second C-clamp.

15. A method of using a clamp tool device for use in holding a boat in a relatively stationary position while the boat is floating in shallow water, said method comprising obtaining the device consisting essentially of:

a first C-clamp having a top edge, a generally rectangular shaped flat upper lip, and a generally circular flat lower lip; and a second C-clamp having a back edge, a generally rectangular shaped flat upper lid, and a generally circular flat lower lip, the second C-clamp is orthogonally attached to the first C-clamp, wherein the back edge of the second C-clamp is in direct contact with the top edge of the first C-clamp such that said upper lip and said lower lip of said first C-clamp are orthogonal to said upper lip and said lower lip of said second C-clamp;

getting into the boat floating in a lake having a muddy bottom, wherein the boat has a gunnel edge and an oar;

positioning the boat in the lake at a depth less than the length of the oar, tightening the lower and upper lips of the first C-clamp of the device onto the gunnel of the boat;

ramming the distal end of the oar into the bottom muddy bottom of the lake; and securing the lower and upper lips of the second C-clamp of the device onto the proximate end of the oar.

* * * * *